United States Patent [19]

Hollis

[11] 3,966,115

[45] June 29, 1976

[54] STEPPED AND ANGLE-CUT, PINCH CLOSURE

[75] Inventor: Clinton R. Hollis, Camden, Ark.

[73] Assignee: International Paper Company, New York, N.Y.

[22] Filed: Nov. 25, 1974

[21] Appl. No.: 526,789

[52] U.S. Cl. ..... 229/55; 93/35 R; 229/62

[51] Int. Cl.[2] ..... B65D 33/02; B65D 33/18

[58] Field of Search ..... 229/55, 62; 93/35 R

[56] References Cited

UNITED STATES PATENTS

| | | | |
|---|---|---|---|
| 1,821,207 | 9/1931 | Cornell | 229/55 |
| 1,917,975 | 7/1933 | Jaite | 229/55 |
| 2,764,339 | 9/1956 | Owens | 229/55 |
| 2,776,084 | 1/1957 | Williams | 229/55 |
| 2,810,509 | 10/1957 | Gelboke | 229/55 |
| 3,058,647 | 10/1962 | Reiselt | 229/55 |
| 3,365,116 | 1/1968 | Ludlow | 229/55 |
| 3,650,460 | 3/1972 | Lokey | 229/55 |
| 3,687,356 | 8/1972 | Goodrich | 229/55 |
| 3,776,451 | 12/1973 | Goodrich | 229/55 |

*Primary Examiner*—Stephen P. Garbe
*Attorney, Agent, or Firm*—Ronald A. Schapira

[57] ABSTRACT

An end construction for forming a pinch closure over the opening in an end of a multi-ply, tubular bag, which includes a stepped and angle-cut flap on the portion of each ply on one side of the opening in the end of the bag, and a stepped and angle-cut cut-out in the portion of each ply on the other side of the opening in the end of the bag, the flap on each ply being adapted to fold about a fold line, located inwardly of the opening, to overlap the leading edge of the cut-out in the ply. The pinch closure is formed from the end construction by the steps of folding the flap on each ply about the fold line, over the opening in the end of the bag and over the stepped and angle-cut cut-out in the ply, and adhesively bonding the flap to the underlying portions of the ply in the area of the leading edge of the stepped and angle-cut cut-out in the ply.

14 Claims, 4 Drawing Figures

STEPPED AND ANGLE-CUT, PINCH CLOSURE

BACKGROUND OF THE INVENTION

This invention relates to an end construction for forming a pinch closure for the opening in an end of a multi-ply, tubular bag, such as the outer, protective shell of a dunnage bag. This invention is particularly concerned with an end construction which can be expeditiously converted into a strong and durable, pinch closure, without the need for repetitive, manual steps.

Pinch closures for the ends of multi-ply, tubular bags are well known in the art. See, for example, the pinch closure for the outer shell of a dunnage bag in U.S. Pat. No. 3,365,116.

Such pinch closures have been formed from an end construction which includes an angle-cut flap on one side of each ply of the bag and an angle-cut cut-out in the other side of each ply of the bag. Each flap has been adapted to fold over the opening in the end of the multi-ply, tubular bag and to be interleaved between and adhesively bonded to the portions of the plies on the other side of the opening in the bag. In forming the pinch closure, each flap has been folded about a fold line, coincidental with the opening in the end of the bag, surface coated with an adhesive, and then manually interleaved between the portions of the plies on the other side of the opening in the end of the bag. A strong, pinch closure for a multi-ply bag has been formed in this way. In fact, in dunnage bags, the resulting pinch closure for the outer protective shell has been found to be sufficiently strong so that the closure does not break when the bladder, inside the multi-ply shell, is inflated or the dunnage bag is squeezed between shifting loads of freight in a freight car.

However, such end constructions in multi-ply bags have been somewhat unsatisfactory due to the need for manually interleaving several flaps between plies to form the pinch closure. That manual interleaving of the plies has been required has been considered as unduly increasing the cost of producing such multi-ply bags. There has been an unfilled need, therefore, for a means of forming a pinch closure in a multi-ply bag without the need for manually interleaving flaps to close the opening in the end of the bag and without sacrificing the strength or durability of the bag.

SUMMARY OF THE INVENTION

In accordance with this invention, an improved end construction for forming a pinch closure for the opening in an end of a multi-ply, tubular bag is provided, wherein at least two plies include: a stepped and angle-cut flap on the portion of each ply on one side of the opening in the end of the bag; and a stepped and angle-cut cut-out in the portion of each ply on the other side of the opening in the end of the bag; the flap on each ply being adapted to fold about a fold line, located inwardly of the opening in the end of the bag, to overlap the leading edge of the cut-out in the ply. By this end construction, a pinch closure can be expeditiously formed in a multi-ply, tubular bag without the need for any interleaving of flaps.

In accordance with another aspect of this invention, a pinch closure for the opening in an end of a multi-ply, tubular bag and a method of forming the pinch closure from the end construction of this invention are provided by the steps of: for at least two plies, folding the stepped and angle-cut flap on each ply, about the fold line located inwardly of the opening in the end of the bag, over the opening in the end of the bag and over the stepped and angle-cut cut-out in the ply; and adhesively bonding the flap on each ply to the underlying portions of the ply about the leading edge of the stepped and angle-cut cut-out in the ply. The pinch closure and method of forming the pinch closure, from the end construction of this invention, provide a strong and neat, pinch closure in the end of a multi-ply, tubular bag, without the need for interleaving flaps between portions of the plies of the bag.

DETAILED DESCRIPTION OF THE INVENTION

Figure 1:
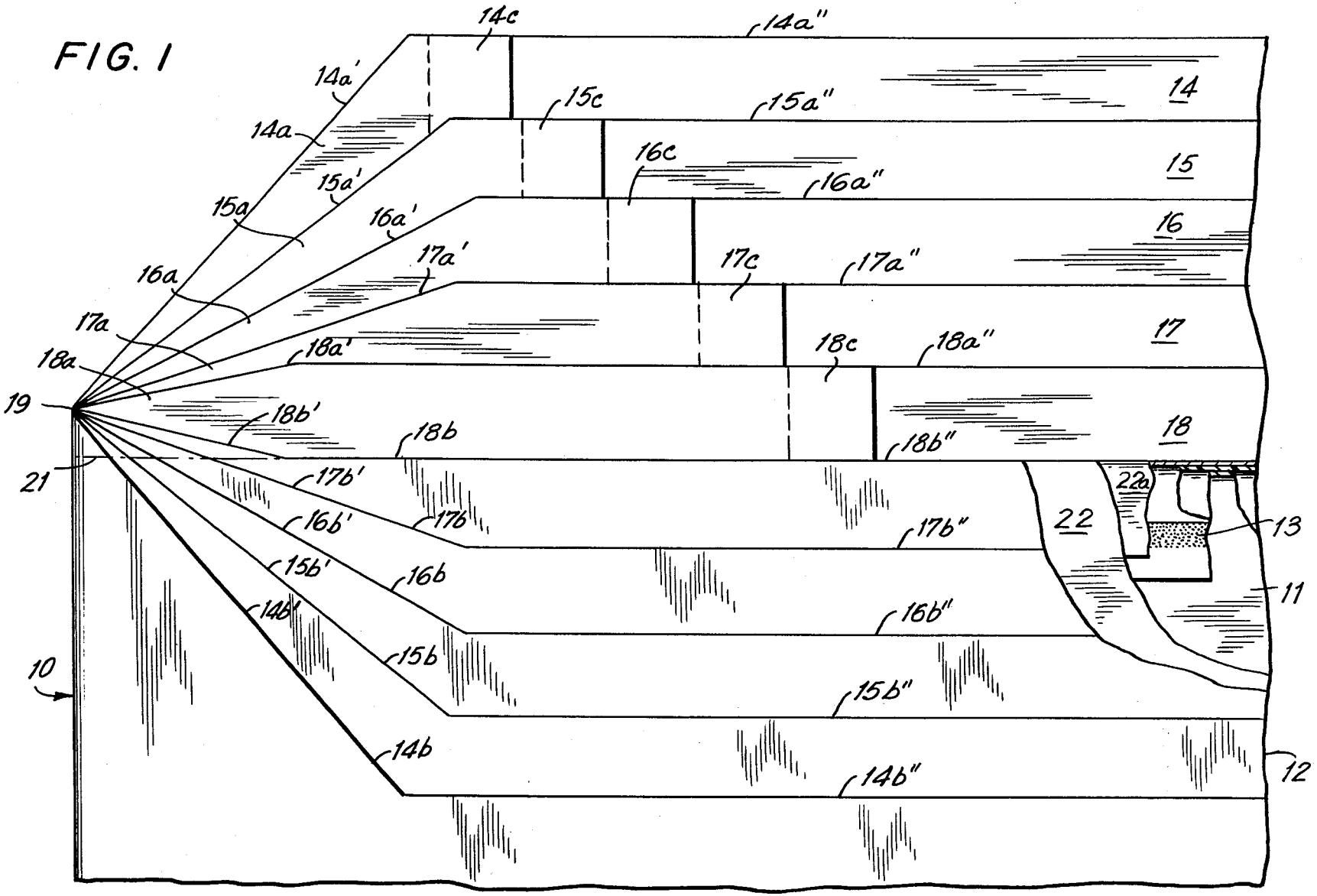
FIG. 1 is a plan view of a portion of the end construction for the opening in the end of a multi-ply, tubular bag in accordance with this invention. A portion of the end of the bag is partially cut away to show the relationship of the several plies which comprise the bag.

Shown in FIG. 1 is a portion of an end construction in a multi-ply, tubular bag, generally 10, useful as a dunnage bag. The bag 10 includes an inner, plastic bladder 11 and a plurality of tubular, concentric plies which form an outer, protective shell, generally 12. The inner bladder 11 is made from a conventional, tubular, plastic film, such as polyethylene or polypropylene. The end of the tubular, plastic film is folded over and heat-sealed to form a tight, end closure 13 for the bladder 11.

In the multi-ply bag 10 shown in FIG. 1, the outer, protective shell 12 comprises at least two plies of a relatively strong and durable, protective material, such as kraft paper. In the embodiment shown in FIG. 1, the outer shell 12 comprises five, concentric tubular plies 14, 15, 16, 17 and 18. The multi-ply shell 12 has an outermost ply 14 and an innermost ply 18. Attached to each tubular ply 14–18 is a stepped and angle-cut flap **14*a*, 15*a*, 16*a*, 17*a* and 18*a*. Each flap 14*a*–18*a* is attached to the portion of each ply 14–18 on one side of an opening in the end of the bag 10. In each ply 14–18, on the other side of the opening in the bag 10, is provided a stepped and angle-cut cut-out, defined by a stepped and angle-cut cut-out edge 14*b*, 15*b*, 16*b*, 17*b* and 18*b* in each ply 14–18**.

The stepped and angle-cut, lateral edges **14*a*′–18*a*′ of the flaps 14*a*–18*a* intersect at two points 19 and 20 (point 20 not shown in FIG. 1). Likewise, the stepped and angle-cut, lateral edges 14*b*′–18*b*′ of the cut-out edges 14*b*–18*b* intersect at points 19 and 20. The points 19 and 20 lie along the lateral edges of the multi-ply bag 10 and constitute the lateral extremities of the flaps 14*a*–18*a* and of the cut-out edges 14*b*–18*b*. Hence, the lateral, flap edges 14*a*′–18*a*′ and the lateral cut-out edges 14*b*′–18*b*′ intersect at points 19 and 20**.

In FIG. 1, only half of each stepped and anglecut flap **14*a*–18*a* and only half of each stepped and angle-cut cut-out, defined by cut-out edges 14*b*–18*b*, for the plies 14–18 are shown. In accordance with this invention, the other half of each flap and cut-out edge (not shown in FIG. 1) is preferably a mirror image of the half of each flap and cut-out edge shown in FIG. 1. Hence, each flap 14a–18a and each cut-out edge 14b–18b, in accordance with this invention, preferably define substantially trapezoidal shapes. The longer base of the trapezoidal flaps 14a–18a and cut-out edges 14b–18b is the line between points 19 and 20. The shorter base of each trapezoidal flap 14a–18a is its stepped, leading edge 14a''–18a'', and the shorter base of each cut-out edge 14b–18b is its stepped, leading edge 14b''–18b''. It is particularly preferred that, for each ply, the trapezoidal flap 14a–18a** and the trapezoidal cut-out have substantially identical shapes, i.e., the same height and bases.

The line connecting points 19 and 20 in the end construction of this invention defines the opening in the end of the multi-ply shell 12, which is the same as the opening in the end of the multi-ply bag 10. Hence, the line connecting points 19 and 20 will hereinafter be referred to as the "opening in the end of the bag 10".

With respect to the opening in the end of the bag 10, the lateral flap edges 14a'–18a' and the lateral cut-out edges 14b'–18b' describe acute angles. As seen from FIG. 1, the angle included between the lateral flap edge 14a' and the opening in the end of the bag 10 and the angle included between the lateral cut-out edge 14b' and the opening in the end of the bag 10 are the largest angles included by lateral flap edges 14a'–18a' and lateral cut-out edges 14b'–18b'. Likewise, the angle included between the lateral flap edge 18a' and the opening in the end of the bag 10 and the angle included between lateral cut-out edge 18b' and the opening in the end of the bag 10 are the smallest angles included by lateral flap edges 14a'–18a' and lateral cut-out edges 14b'–18b'.

It is preferred that the difference in the included angles between the lateral edges 14a'–18a' of adjacent flaps 14a–18a, particularly of inner, adjacent flaps 15a–18a, be about 10°. Likewise, it is preferred that the difference in the included angles between the lateral edges 14b'–18b' of adjacent cut-out edges 14b–18b, particularly of inner, adjacent, cut-out edges 15b–18b, also be about 10°. Hence, it is preferred that, for example, the angle included between lateral flap edge 15a', of ply 15, and the opening in the end of the bag 10 be about 10° larger than the angle included between lateral flap edge 16a', of the adjacent ply 16, and the opening in the end of the bag. Similarly, it is preferred that the angle included between the lateral cut-out edge 15b', of ply 15, and the opening in the end of the bag 10 be about 10° larger than the angle included between the lateral cut-out edge 16b', of the adjacent ply 16, and the opening in the end of the bag 10.

It is also preferred that, for each ply 14–18, particularly for each inner ply 15–18, the angle included between the lateral flap edge 14a'–18a' and the opening in the end of the bag 10 be the same as the angle included between the lateral cut-out edge 14b'–18b' and the opening in the end of the bag 10. As seen from FIG. 1, in a five ply shell 12, it is especially preferred that both the angle included between the lateral flap edge 14a' and the opening in the end of the bag 10 and the angle included between the lateral cut-out edge 14b' and the opening in the end of the bag 10, in the outermost ply 14, be equal to about 60°. Likewise, it is also especially preferred in a five ply shell 12 that both the angle included between the lateral flap edge 18a' and the opening in the end of the bag 10 and the angle included between the lateral cut-out edge 18b' and the opening in the end of the bag 10, in the innermost ply 18, be about 20°.

However, in accordance with this invention, the particular angles described by lateral flap edges 14a'–18a' and lateral cut-out edges 14b'–18b' with respect to the opening in the end of the bag 10 and the differences between the angles described by the lateral flap edges and lateral cut-out edges by adjacent plies are not critical. Likewise, that, for each ply 14–18, the angle described by the lateral flap edge 14a'–18a' is the same or about the same as the angle defined by the lateral cut-out edge 14b'–18b' is also not critical. All that is required is that each flap 14a–18a be sufficiently large so that its overlap of the cut-out edge 14b–18b in its ply allows a strong, adhesive bond to be formed between the flap and its underlying ply and that each cut-out edge of an inner ply 15–18 be sufficiently separated from the cut-out edge of the adjacent, outer ply 14–17 so that the surface area between them permits strong, adhesive bonding of each inner flap 15a–18a to the underlying portions of its respective ply. The proper overlap of the flaps 14a–18a and the proper separation of cut-out edges 14b–18b is particularly required in the areas of each inner ply 15–18, about the cut-out edge 15b–18b, farthest from the opening in the end of the bag 10, i.e., the portions about the leading cut-out edge 15b''–18b''.

As is also shown in FIG. 1, a fold line 21 is provided in the end of the multi-ply bag 10. The fold line 21 is located inwardly of and substantially parallel to the opening in the end of the bag 10. Preferably, the fold line 21 coincides with the leading edge 18b'' of the cut-out edge 18b in the innermost ply 18 of the protective shell 12. As a result, each of the trapezoidal flaps 14a–18a can be folded along fold line 21 to overlap substantial, underlying portions of the cut-out edge 14b–18b in its respective ply—including the leading cut-out edge 14b''–18b'' in its ply, as well as significant portions of the lateral cut-out edges 14b'–18b' in the ply.

However, the location of the fold line 21 is not critical. The fold line 21 can, if desired, be suitably located anywhere between the opening in the end of the bag 10 and the leading edge 14b'' of the cut-out edge 14b of the outermost ply 14, so long as, for each ply 14–18, its flap 14a–18a can be folded along fold line 21 to overlap substantial portions of the ply, on the other side of the opening in the end of the bag 10, about the leading cut-out edge 14b''–18b'' of the ply and so long as the overlap of a flap of an inner ply 15–18 does not unduly interfere with the overlapping of a flap of an outer ply 14–17. The overlap of each flap 14a–18a about the leading cut-out edge 14b''–18b'' in its ply must be sufficient to enable a strong, adhesive bond to be formed between each flap and its underlying ply portion, at least in the area about the leading cut-out edge 14b''–18b'' in the ply. It is preferred, in this regard, that the distance of the fold line 21 from the opening in the end of the bag 10 be such that an overlap, between each flap 14a–18a and its respective, underlying ply portion, about the leading cut-out edge 14b''–18b'', of about ¼ inch to about 2 inches, preferably about ½ inch to about one inch, is obtained.

Still further shown in FIG. 1 are the longitudinal, overlapping portions 14c–18c, for each ply 14–18, which are bonded together to form each of the tubular plies 14–18.

Also seen in FIG. 1 is a tubular, protective ply 22, surrounding the inner bladder 11. The protective ply 22 can be formed of the same material as the plies of the outer protective shell 12, such as kraft paper. If desired, the protective ply 22 also can be provided with a flap 22*a*, on one side of the protective ply 22, which may or may not be angle-cut. The flap 22*a* can be folded about the end of the bladder 11 to completely enclose the bladder 11 inside the protective ply 22. The purpose of the protective ply 22 is to prevent the bladder 11 from becoming adhesively bonded to the plies 14–18 of the protective shell 12 when the pinch closure of this invention is formed. The protective ply 22 assures that the pinch closure can be expeditiously formed, using an adhesive, without interferring with the proper inflation and expansion of the bladder 11 in the resulting, closed bag.

As further seen in FIG. 1, in accordance with this invention, an end construction for forming a pinch closure for the opening in the end of a multi-ply, tubular bag 10 is provided, in which at least two plies include a stepped and angle-cut flap 14*a*–18*a* on the portion of each ply 14–18 on one side of the opening in the end of the bag 10; and a stepped and angle-cut cut-out, defined by the cut-out edge 14*b*–18*b*, in the portion of each ply 14–18 on the other side of the opening in the end of the bag 10; the flap on each ply being adapted to fold about a fold line 21, located inwardy of the opening in the end of the bag 10, to overlap the leading edge 14*b*''–18*b*'' of the cut-out in the ply 14–18.

Figure 2:
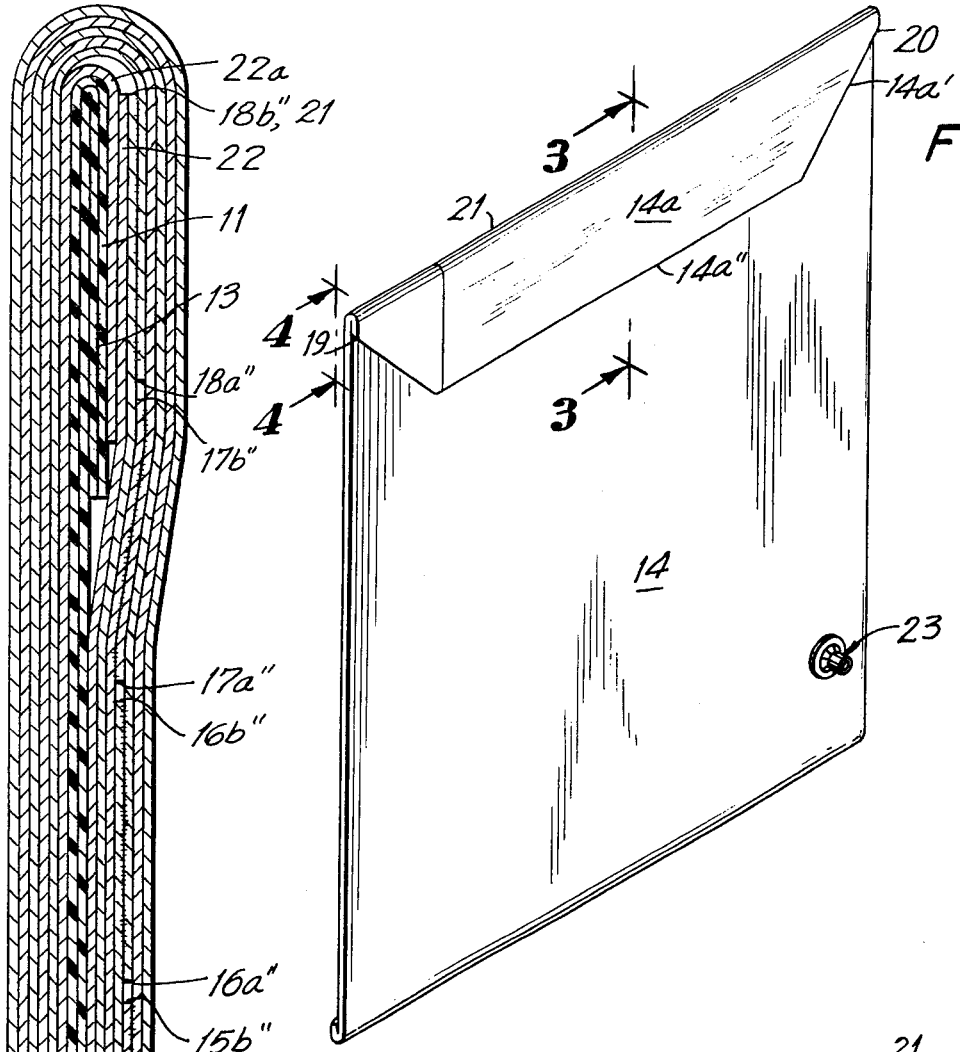
FIG. 2 is a perspective view of a pinch closure, formed from the end construction in the multi-ply, tubular bag of FIG. 1.
Figure 3:
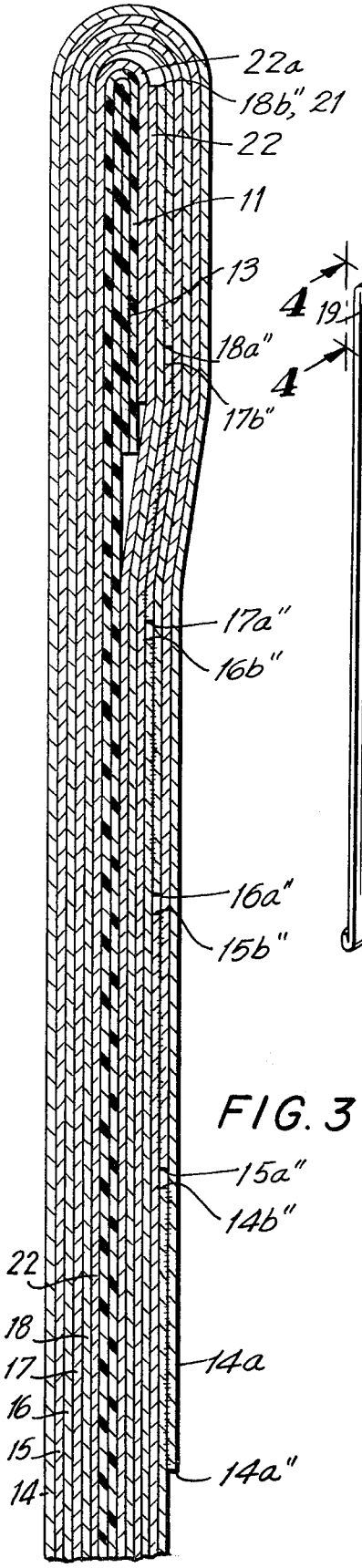
FIG. 3 is a sectional view, taken along line 3—3 in FIG. 2, showing the pinch closure.
Figure 4:
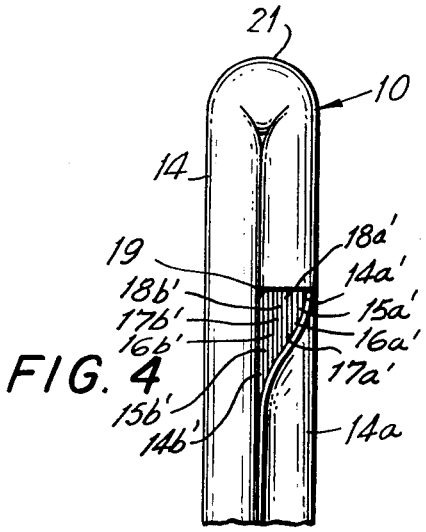
FIG. 4 is a detailed, plan view of the pinch closure of the multi-ply, tubular bag, taken along line 4—4 in FIG. 2.

Shown in FIGS. 2, 3 and 4 is the pinch closure of this invention, formed from the end construction of FIG. 1. The pinch closure includes an outer, stepped and angle-cut flap 14*a*, connected on one side of the opening in the end of the bag 10 to the outermost ply 14. The flap 14*a* has been folded about the fold line 21, over the opening in the end of the bag 10 and over a stepped and angle-cut cut-out, defined by the cut-out edge 14*b* in the ply 14, on the other side of the opening in the end of the bag 10. Similarly, the other, inner flaps 15*a*–18*a* have been folded about the fold line 21, over the opening in the end of the bag 10 and over the stepped and angle-cut cut-outs, defined by the cut-out edges 15*b*–18*b*, in the inner plies 15–18, on the other side of the opening in the end of the bag 10.

The outer flap 14*a* is adhesively bonded to the underlying portions of the ply 14 about the leading cut-out edge 14*b*'' and about the lateral cut-out edges 14*b*'. In this way, the outer flap 14*a* covers all of the underlying cut-out edges 14*b*–18*b* and all of the inner flaps 15*a*–18*a*. The inner flaps 15*a*–18*a* are also adhesively bonded to the underlying portions of their respective plies 15–18, at least about the leading cut-out edges 15*b*''–18*b*''. In the preferred pinch closure of this invention, formed from the end construction of FIG. 1, each of the inner, trapezoidal flaps 15*a*–18*a* is adhesively bonded to the underlying portions of its ply about the leading cutout edge 15*b*''–18*b*'' as well as about significant portions of each of the lateral cut-out edges 15*b*'–18*b*'.

The pinch closure of FIGS. 2–4, formed from the end construction of FIG. 1, is quite strong because each of the plurality of flaps 14*a*–18*a* is adhesively bonded to substantial portions of its respective ply on the other side of the opening in the end of the bag 10, including substantial portions about the leading cut-out edge 14*b*''–18*b*'. The resulting closure also has a neat appearance because the flap 14*a* of the outermost ply 14 completely covers all of the stepped and angle-cut cut-out edges 14*b*–18*b* in all of the plies 14–18 of the shell 12.

However, besides providing a pinch closure for a multi-ply bag having a strength and appearance comparable to that of prior, pinch closures, the end construction of this invention provides a significant advantage in forming a pinch closure.

The pinch closure of this invention can be easily assembled without the need for manually interleaving flaps between plies. In fact, no interleaving of flaps is required at all in accordance with the pinch closure of this invention. The pinch closure of FIGS. 2–4 can be formed from the end construction of FIG. 1 merely by applying an adhesive to the surface of the flaps 14*a*–18*a*, or to the plies 14–18, about the cut-out edges 14*b*–18*b* in each ply, or both; and sequentially, starting from the flaps of the inner ply 18, folding the flaps 14*a*–18*a* over fold line 21 and pressing the flaps to the underlying portions of the plies 14–18. In accordance with this method, any conventional adhesive for bonding plies of a multi-ply bag can be utilized. Preferably, in a dunnage bag 10, wherein the plies 14–18 of the outer shell 12 are kraft paper, the adhesive utilized is polyvinyl acetate.

In the end construction and the pinch closure of this invention, particular configurations and dimensions for the flaps 14*a*–18*a* and the cut-out edges 14*b*–18*b* and particular numbers of such flaps and cut-out edges are not critical.

While it is preferred that the flaps and cut-outs define generally trapezoidal shapes, other shapes may be suitably utilized. Among such shapes are arcuate shapes, e.g., a parabola, wherein the stepped, leading edges 14*a*''–18*a*'' and 14*b*''–18*b*'' of the flaps and cut-outs are the central, edge portions most spaced from the opening in the end of the bag 10, and the stepped and angle-cut, lateral edges 14*a*'–18*a*' and 14*b*'–18*b*' of the flaps and cut-outs are the lateral edge portions adjacent the opening in the end of the bag 10. Similarly, while it is preferred that, for each ply, the flaps and cut-outs have substantially identical shapes, this is not necessary. The flaps and cut-outs of plies can have any compatible shape, so long as, for each ply, the overlap of the flap about the leading cut-out edge is sufficient to allow for strong, adhesive bonding and does not unduly interfere with the overlap and bonding of the flap of an outer ply in the area of the leading edge of the cut-out in the outer ply. In this regard, it is preferred, regardless of flap and cut-out shape, that the flap and cut-out edge in each ply have dimensions such that the flap overlaps the leading cut-out edge by ¼ to 2 inches, preferably ½ to 1 inch.

Besides the relationship between the stepped and angle-cut flaps and the stepped and angle-cut cut-outs in the plies 14–18 and the relationship of the flaps and cut-outs to the opening in the end of the bag 10 and to the fold line 21, all of the elements of the multi-ply bag 10 are conventional. The inner bladder 11 and outer shell 12 are formed of conventional materials typically found in multi-ply, tubular bags, such as dunnage bags and the like. Likewise, the adhesive used to bond the edge portions 14*c*–18*c* of the plies of the outer shell 12 to form the tubular plies 14–18, the adhesive used to bond the flaps 14*a*–18*a* to the underlying portions of the respective plies 14–18, and the means for forming the end closure 13 of he inflatable bladder 11 are all conventional. Similarly, the valve means 23 for inflating the bladder 11 in the multi-ply bag 10 is also conventional.

It is thought that the invention and many of its attendant advantages will be understood from the foregoing description, and it will be apparent that various changes may be made in the form, construction and arrangement of the parts of the end construction and the pinch closure and in the steps of the process for forming the pinch closure from the end construction without departing from the spirit and scope of the invention or sacrificing all of its material advantages, the form and process hereinbefore described being merely preferred embodiments thereof.

I claim:

1. In an end construction for forming a pinch closure for the opening in an end of a multi-ply, tubular bag, the improvement which comrises:

at least two plies of said bag including a stepped and angle-cut flap on the portion of each ply on one side of the opening in the end of the bag and a stepped and angle-cut cut-out in the portion of each ply on the other side of the opening in the end of the bag;

each flap on one of said at least two plies having a leading edge remote from the opening in the end of the bag and a pair of lateral edges connected to the ends of the leading edge and the opening in the end of the bag;

the leading edge of the flap on an outer ply of said at least two plies being spaced a greater distance from the opening in the bag than the leading edge of the flap on an inner ply of said at least two plies; and the lateral edges of the flap on an outer ply of said at least two plies including greater angles with the opening in the bag than the lateral edges of the flap on an inner ply of said at least two plies; and each cut-out in one of said at least two plies having a leading edge remote from the opening in the end of the bag and a pair of lateral edges connected to the ends of the leading edge and the opening in the end of the bag;

the leading edge of the cut-out in an outer ply of said at least two plies being spaced a greater distance from the opening in the bag than the leading edge of the cut-out in an inner ply of said at least two plies; and the lateral edges of the cut-out in an outer ply of said at least two plies including greater angles with the opening in the bag than the lateral edges of the cut-out in an inner ply of said at least two plies; and the flap on each ply being adapted to fold about a fold line, located inwardly of the opening in the end of the bag, to overlap the leading edge and the lateral edges of the cut-out in its ply.

2. The end construction of claim 1 wherein the flap on each ply overlaps the leading edge of the cut-out in its ply by ¼ to 2 inches.

3. The end construction of claim 2 wherein the flap on each ply overlaps the leading edge of the cut-out in its ply by ½ to 1 inch.

4. The end construction of claim 1 wherein the flap on each ply and the cut-out in each ply define substantially identical shapes.

5. The end construction of claim 4 wherein the fold line is located such that the flap on each ply overlaps the leading edge of the cut-out in its ply by about ¼ to 2 inches.

6. The end construction of claim 5 wherein the fold line is located such that the flap on each ply overlaps the leading edge of the cut-out in its ply by about ½ to 1 inch.

7. The end construction of claim 4 wherein the flap on each ply and the cut-out in its ply define trapezoidal shapes.

8. The end construction of claim 7 wherein the difference between the angles, included between the lateral edges of the flaps on adjacent plies and the opening in the end of the bag, is about 10°.

9. The end construction of claim 7 wherein the fold line coincides with the leading edge of the trapezoidal cut-out in the innermost ply.

10. In a pinch closure for the opening in the end of a multi-ply, tubular bag, the improvement which comprises:

at least two plies of said bag including a stepped and angle-cut flap on the portion of each ply on one side of the opening in the end of the bag, and a stepped and angle-cut cut-out in the portion of each ply on the other side of the opening in the end of the bag;

each flap on one of said at least two plies having a leading edge remote from the opening in the end of the bag and a pair of lateral edges connected to the ends of the leading edge and the opening in the end of the bag;

the leading edge of the flap on an outer ply of said at least two plies being spaced a greater distance from the opening in the bag than the leading edge of the flap on an inner ply of said at least two plies; and the lateral edges of the flap on an outer ply of said at least two plies including greater angles with the opening in the bag than the lateral edges of the flap on an inner ply of said at least two plies; and each cut-out in one of said at least two plies having a leading edge remote from the opening in the end of the bag and a pair of lateral edges connected to the ends of the leading edge and the opening in the end of the bag;

the leading edge of the cut-out in an outer ply of said at least two plies being spaced a greater distance from the opening in the bag than the leading edge of the cut-out in an inner ply of said at least two plies; and the lateral edges of the cut-out in an outer ply of said at least two plies including greater angles with the opening in the bag than the lateral edges of the cut-out in an inner ply of said at least two plies; and the flap on each ply being folded over the opening in the end of the bag, about a fold line, located inwardly of the opening in the end of the bag, and being bonded to portions of its ply, on the other side of the opening in the end of the bag, about the leading edge and the lateral edges of the cut-out in its ply.

11. The pinch closure of claim 10 wherein the flap on each ply and the cut-out in each ply define substantially identical shapes.

12. The pinch closure of claim 12 wherein the flap on each ply and the cut-out in its ply define trapezoidal shapes.

13. The pinch closure of claim 13 wherein the difference between the angles, included between the lateral edges of the flaps on adjacent plies and the opening in the end of the bag, is about 10°.

14. A method of forming a pinch closure in a multi-ply, tubular bag, which comprises:

folding a stepped and angle-cut flap, on the portion of each of at least two plies of the bag on one side of an opening in the end of the bag, about a fold line located inwardy of the end of the bag and over a stepped and angle-cut cut-out in its ply on the other side of the opening in the end of the bag;

each flap on one of said at least two plies having a leading edge remote from the opening in the end of the bag and a pair of lateral edges connected to the ends of the leading edge and the opening in the end of the bag;

the leading edge of the flap on a outer ply of said at least two plies being spaced a greater distance from the opening in the bag than the leading edge of the flap on an inner ply of said at least two plies; and the lateral edges of the flap on an outer ply of said at least two plies including greater angles with the opening in the bag than the lateral edges of the flap on an inner ply of said at least two plies; and each cut-out in one of said at least two plies having a leading edge remote from the opening in the end of the bag and a pair of lateral edges connected to the ends of the leading edge and the opening in the end of the bag;

the leading edge of the cut-out in an outer ply of said at least two plies being spaced a greater distance from the opening in the bag than the leading edge of the cut-out in an inner ply of said at least two plies; and the lateral edges of the cut-out in an outer ply of said at least two plies including greater angles with the opening in the bag than the lateral edges of the cut-out in an inner ply of said at least two plies; and adhesively bonding each flap to the underlying portion of its ply on the other side of the opening in the end of the bag, about the leading edge and the lateral edges of the cut-out in its ply.

* * * * *

UNITED STATES PATENT OFFICE

CERTIFICATE OF CORRECTION

PATENT NO. : 3,966,115

DATED : June 29, 1976

INVENTOR(S) : Clinton R. Hollis

It is certified that error appears in the above-identified patent and that said Letters Patent are hereby corrected as shown below:

at column 2, line 65, "anglecut" should be -- angle-cut -- ;

at column 7, line 2, "he" should be -- the -- ;

at column 8, line 64, "12", second occurrence, should be -- 11 -- ; and at column 8, line 67, "13", second occurrence, should be -- 12 -- .

Signed and Sealed this

Nineteenth Day of October 1976

[SEAL]

*Attest:*

RUTH C. MASON
*Attesting Officer*

C. MARSHALL DANN
*Commissioner of Patents and Trademarks*